United States Patent [19]

Kun

[11] Patent Number: 4,904,158

[45] Date of Patent: Feb. 27, 1990

[54] METHOD AND APPARATUS FOR CRYOGENIC LIQUID EXPANSION

[75] Inventor: Leslie C. Kun, Grand Island, N.Y.

[73] Assignee: Union Carbide Corporation, Danbury, Conn.

[21] Appl. No.: 233,379

[22] Filed: Aug. 18, 1988

[51] Int. Cl.[4] ..... F01D 5/04

[52] U.S. Cl. ..... 416/183; 415/1; 415/914

[58] Field of Search ..... 416/183; 415/181, DIG. 1, 415/9, 14

[56] References Cited

U.S. PATENT DOCUMENTS

| | | | |
|---|---|---|---|
| 1,959,703 | 5/1934 | Birmann | 416/183 |
| 2,484,554 | 10/1949 | Concordia et al. | 416/183 |

FOREIGN PATENT DOCUMENTS

| | | | |
|---|---|---|---|
| 113202 | 6/1984 | Japan | 416/183 |
| 992749 | 1/1983 | U.S.S.R. | 416/183 |
| 1059217 | 12/1983 | U.S.S.R. | 416/188 |
| 1073495 | 2/1984 | U.S.S.R. | 416/183 |
| 1160061 | 6/1985 | U.S.S.R. | 416/183 |

OTHER PUBLICATIONS

Perry's Chemical Engineer's Handbook, D. W. Green ed., McGraw-Hill Book Company, pp. 24-32 to 24-37, 1984.

*Primary Examiner*—Everette A. Powell, Jr.
*Attorney, Agent, or Firm*—Stanley Ktorides

[57] ABSTRACT

A method and apparatus for work expanding a cryogenic liquid wherein the liquid is expanded in a manner to avoid a transient pressure drop below the flash point thus reducing the potential for cavitation and consequent operating inefficiencies.

17 Claims, 1 Drawing Sheet

METHOD AND APPARATUS FOR CRYOGENIC LIQUID EXPANSION

TECHNICAL FIELD

This invention relates generally to the field of cryogenic liquid expansion to produce work and in particular is an improvement whereby such expansion can be carried out with a reduction in the tendency of the liquid to undergo cavitation.

Background Art

A high pressure fluid is often expanded, i.e., reduced in pressure, through a turbine to extract useful energy from the fluid and thus to produce work. The high pressure fluid enters the turbine and passes through a plurality of passages defined by turbine blades which are mounted on an impeller which in turn is mounted on a shaft or rotor. The fluid enters the blade passages and causes rotation of the impeller and the shaft and ultimately leads to the recovery of energy and to the production of work from the spinning shaft.

It is desirable to operate the expansion turbine with as high an efficiency as possible. Maximum efficiency is attained when the fluid passes through the turbine impeller close to the point where the flow separates from the surfaces. This low loss design criteria for turbines with gaseous working fluid usually results in minimizing blade number or maximizing blade loading. In addition, the fewer blades mounted on the impeller the lower the fluid friction losses as the fluid passes through the turbine against the blades. Finally the lesser the number of blades the lower is the fabrication cost of the turbine. In summary, for a variety of reasons, fluid work expansion turbines are designed with a small number of blades for any given impeller diameter.

Another method for increasing the efficiency of a work expansion turbine is to pass the working fluid through a diffuser after it exits the turbine. A diffuser is a conical conduit which is attached to the exit end of the turbine. Fluid exiting the turbine and passing through the diffuser is allowed to slow down without an excessive pressure loss, i.e., is allowed to diffuse. This diffusion enables recovery of kinetic energy present in the exhaust stream issuing from the impeller.

A particular problem which arises in the work expansion of a cryogenic liquid is cavitation within the expanding liquid. A cryogenic liquid is a liquid whose normal boiling point is below about 150° K. Examples of a cryogenic liquid include liquid air, liquid nitrogen, liquid oxygen, liquid methane and liquified natural gas. Cavitation is the formation of bubbles within the expanding liquid and the subsequent collapse of these bubbles as the liquid completes its passage through the turbine. The vaporization of the liquid resulting in the formation of such bubbles is caused by a momentary drop in pressure along the fluid flow path, and the collapse of the bubbles occurs when the fluid pressure rises above the flash point. Cavitation is extremely harmful to the efficient operation of a work expansion turbine, often causing rapid erosion of the impeller and other parts of the machine.

Accordingly it is an object of this invention to provide a method whereby a cryogenic liquid may be work expanded through a turbine in a manner so as to reduce cavitation and thus increase the efficiency of the work expansion by allowing the properties of the working fluid to closely approach the saturated liquid condition.

It is a further object of this intention to provide an apparatus which can expand a cryogenic liquid to produce work in a manner so as to reduce cavitation and thus increase the efficiency of the work expansion.

SUMMARY OF THE INVENTION

The above and other objects which will become apparent to one skilled in the art upon a reading of this disclosure are attained by the present invention one aspect of which is:

A method for expanding a cryogenic liquid with reduced cavitation comprising:

(A) providing the cryogenic liquid into a turbine comprising a shaft, an impeller mounted on the shaft, and a plurality N of turbine blades mounted on the impeller, N being within the range of from 0.8 to 1.2 times 20 $D^{0.25}$ where D is the outside diameter of the impeller in inches;

(B) expanding the cryogenic liquid by passing it through the flow channels between the said plurality of blades thus imparting pressure onto the blades and developing pressure difference across each blade so as to cause rotation of the impeller and shaft; and (C) removing the cryogenic liquid from the turbine at a pressure less than its pressure when it entered the turbine.

Another aspect of the invention is:

An expansion turbine for work expanding a cryogenic liquid with reduced cavitation comprising: a shaft, an impeller mounted on the shaft, and a plurality N of turbine blades mounted on the impeller, N being within the range of from 0.8 to 1.2 times 20 $D^{0.25}$ where D is the outside diameter of the impeller in inches.

DETAILED DESCRIPTION

The invention will be described in detail with reference to the Drawings.

Figure 1:
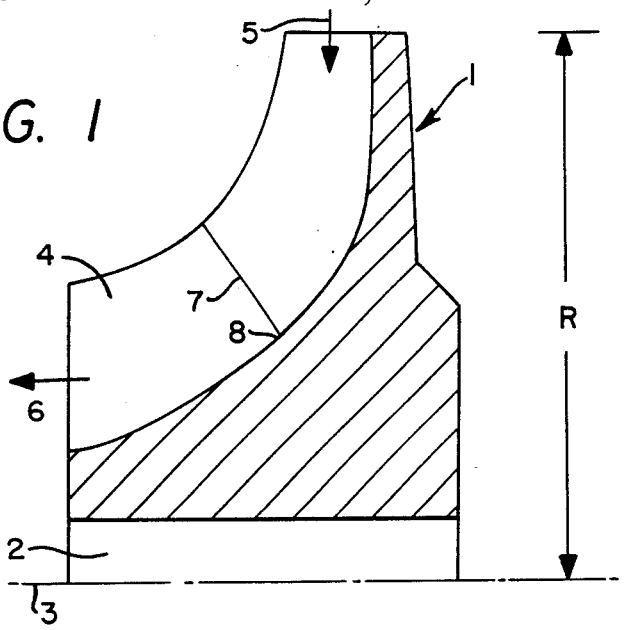
FIG. 1 is a simplified cross-sectional view of the top half of the expansion turbine of this invention.

Referring now to FIG. 1, solid impeller 1 is mounted on rotatable shaft 2. As previously indicted, FIG. 1 is a top half cross-section and shows the expansion turbine above centerline 3. The bottom half of the expansion turbine, identical to the illustrated top half, would be below centerline 3. Mounted on impeller 1 is a plurality of turbine blades 4 which form flow channels between themselves.

In operation a cryogenic liquid such as liquid nitrogen, generally at a pressure within the range of from 400 to 1600 psia, is provided into the turbine such as shown by arrow 5. The cryogenic liquid flows through the flow channels between each pair of blades and in doing so imparts pressure onto the blades causing the impeller and thus the shaft to rotate. Energy is recovered from the rotating shaft; for example the rotating shaft may be connected to an electric generator. The cryogenic liquid is removed from the turbine, such as shown by arrow 6, at a pressure less than its incoming pressure and generally within the range of from 50 to 200 psia.

The present invention comprises the discovery that carrying out the cryogenic liquid expansion through a turbine with a much higher than conventional number of blades for a given impeller size will result in an increased work expansion efficiency despite all the inefficiencies resulting from a high blade number which were discussed previously Applicant has found that his unconventionally high number of blades results in a reduction in the amount of cavitation of the cryogenic liquid as it passes through the turbine and that this reduction in cavitation more than compensates for all the inefficiencies caused by the high blade number.

Applicant has quantified this unconventionally high turbine blade number as being within the range of from 0.8 to 1.2 times 20 $D^{0.25}$ where D is the outside diameter of the impeller in inches. Referring to FIG. 1, D is twice the impeller radius R. Generally the number of turbine blades employed will be about twice the conventional number of blades. For example, in the case of an impeller having a two inch diameter, the factor 20 $D^{0.25}$ would equal 23.78, and the number of turbine blades which are useful in the practice of the invention would be within the range of 0.8 to 1.2 times 23.78, or within the range of from 19 to 28. A conventional work expansion turbine having a two inch impeller would have only about 12 to 14 blades. Generally the expansion turbine of the invention will have an impeller having an outside diameter within the range of from one to seven inches. Expansion turbines having a blade number below the defined minimum will not achieve sufficient cavitation reduction in order to overcome the inefficiencies caused by the high number of blades, and expansion turbines having a blade number in excess of the defined maximum will have very high inefficiencies which will exceed whatever increased efficiency is achieved due to reduced cavitation.

Because of the very high number of blades required by the invention to be mounted on the impeller, it may be very difficult from a fabrication standpoint to fabricate the impeller with the requisite number of blades. Accordingly it may be preferred to practice the invention with one or more partial blades in place of full blades. A partial blade is mounted upon the impeller at the high pressure entrance but extends for only part of the distance to the low pressure exit. In FIG. 1, line 7 illustrates a typical end point of a partial blade. Preferably a partial blade trailing edge is at a point 8, 40 to 60 percent, most preferably about 50 percent, of the radius R of the impeller. In a particularly preferred embodiment of the invention full blades and partial blades alternate on the impeller.

In a further preferred embodiment of the invention, the thickness of each blade is within the range of from 0.015 to 0.030 times the radius R of the impeller. Turbine blades within this defined thickness range further the favorable anti-cavitation effect because of smaller pressure change in the wake of the trailing edges of the blades.

While not wishing to be held to any theory, applicant believes that the advantageous results achieved by the invention are due to the lower pressure difference across any point on the turbine blades. The work extractable from a pressurized fluid is a function of the pressure difference on each point on the surface of the blades integrated over the area of the blades. The invention, by doubling the number of blades significantly increases the total blade area. Thus the pressure difference across each blade from the inlet to the outlet of the blade is lower. This decreases the degree or likelihood of cavitation. Thus even though the turbine has higher fabrication costs and operates with higher friction losses compared to a conventional turbine because of the defined high number of blades, the much lower loading on each blade reduces the amount of transient vaporization or cavitation which occurs as the cryogenic fluid is expanded which, in the narrow defined range of the invention, compensates for the increased inefficiencies so as to enable a net increase in efficiency.

As indicated, a conventional expansion turbine is operated with a diffuser at its exit so as to reduce the outgoing fluid velocity without a pressure drop. Applicant has found that a further anti-cavitation effect is achieved if the invention is operated in the further unconventional manner of being without a diffuser. That is, the fluid upon exiting the expansion turbine undergoes a sudden and pronounced pressure drop. Under conventional practice such a pressure drop would be an undesirable system inefficiency. However in the practice of this invention such a pressure drop has the effect of raising turbine outlet pressure thus further moving the pressure within the turbine away from a point where a small transient pressure reduction at some point within the turbine causes the expanding cryogenic fluid to flash and form a bubble.

Figure 2:
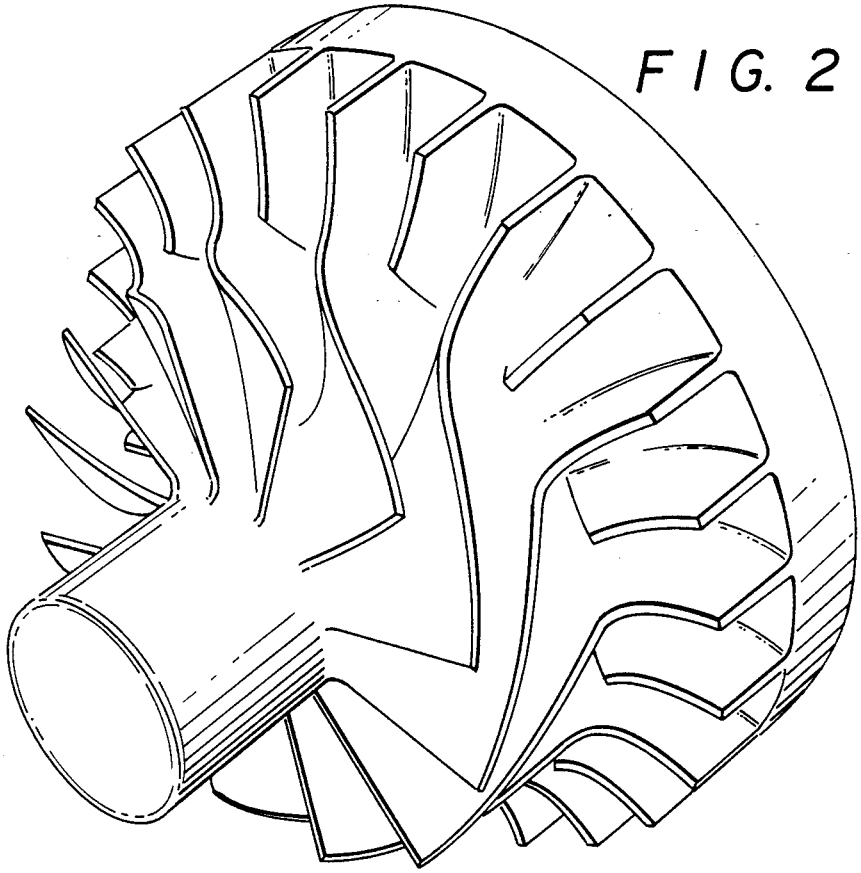
FIG. 2 is an isometric view of one embodiment of the expansion turbine of this invention.

FIG. 2 is an isometric view of one embodiment of the expansion turbine of this invention and is presented for further illustration and explanation of the invention. The embodiment illustrated in FIG. 2 is of an expansion turbine which has an impeller diameter of 1.8 inches and which has 24 blades mounted on the impeller. The blades alternate as full and partial blades.

The following example and comparative example are presented to further illustrate the invention and to demonstrate its difference from conventional practice. The example is not intended to be limiting.

An expansion turbine of conventional design having an impeller diameter of 1.8 inches and having 14 turbine blades mounted on the impeller is used to expand subcooled liquid nitrogen from an inlet pressure of 750 pounds per square inch absolute (psia) to an outlet of pressure of 120 psia. The pressure difference across each blade from the pressure to the suction side of the blade exceeds 200 psi. This pressure difference, with the turbulence effect, will generally cause the formation of vapor bubbles in the expanding fluid within the turbine resulting in cavitation induced operating problems.

A similar cryogenic fluid is similarly expanded through an expansion turbine of this invention having an impeller diameter of 1.8 inches and having 24 turbine blades mounted on the impeller. The pressure difference across each blade is less than 100 psi. Thus the danger of cavitation is greatly reduced. The invention is then operated without a diffuser. This raises the outlet pressure by about 10 psi thus moving the minimum pressure point inside the turbine further away from flashing conditions.

It is indeed suprising and unexpected that a procedure heretofore thought to lead only to increased inefficiencies would ever be advantageous. However, applicant has found that if the turbine blade number is increased to be within a narrow defined range, and if the turbine is used to work expand a cryogenic liquid, an advantageous anti cavitation effect comes into being which will compensate for the known inefficiencies.

Although the invention has been described in detail with reference to certain embodiments, those skilled in the art will recognize that there are other embodiments of the invention within the spirit and scope of the claims.

I claim:

1. A method for expanding a cryogenic liquid with reduced cavitation comprising:

(a) providing the cryogenic liquid into a turbine comprising a shaft, an impeller mounted on the shaft, and a plurality N of turbine blades mounted on the impeller, N being within the range of from 0.8 to 1.2 times 20 $D^{0.25}$ where D is the outside diameter of the impeller in inches forming N flow channels between the blades;

(b) expanding the cryogenic liquid by passing it through the N flow channels between the said plurality of blades thus imparting pressure onto the blades and developing pressure difference across each blade so as to cause rotation of the impeller and shaft; and (c) removing the cryogenic liquid the turbine at a pressure less than its pressure when it entered the turbine.

2. The method of claim 1 wherein the cryogenic liquid is liquid nitrogen.

3. The method of claim 1 wherein the cryogenic liquid is provided into the turbine at a pressure within the range of from 400 to 1600 psia.

4. The method of claim 1 wherein the cryogenic liquid is removed from the turbine at a pressure within the range of from 50 to 200 psia.

5. The method of claim 1 wherein the cryogenic liquid experiences a pressure drop when it exits the turbine.

6. The method of claim 1 wherein D is within the range of from one to seven inches.

7. The method of claim 1 wherein at least one of said turbine blades is a partial blade.

8. The method of claim 7 wherein the turbine blades are mounted on the impeller in alternating fashion so that every full length blade is followed by a partial blade.

9. The method of claim 7 wherein each partial blade has a length such that the trailing edge of each partial blade is within the range of from 40 to 60 percent of the radius of the impeller.

10. The method of claim 1 wherein each blade has a thickness within the range of from 0.015 to 0.030 times the radius of the impeller.

11. An expansion turbine for work expanding a cryogenic liquid with reduced cavitation comprising: a shaft, an impeller mounted on the shaft, and a plurality N of turbine blades mounted on the impeller, N being within the range of from 0.8 to 1.2 times 20 $D^{0.25}$ where D is the outside diameter of the impeller in inches.

12. The turbine of claim 11 free of any diffuser means attached to its exit.

13. The turbine of claim 11 wherein D is within the range of from one to seven inches.

14. The turbine of claim 11 wherein at least one of said turbine blades is a partial blade.

15. The turbine of claim 14 wherein the turbine blades are mounted on the impeller in alternating fashion so that every full length blade is followed by a partial blade.

16. The turbine of claim 14 wherein each partial blade has a length such that the trailing edge of each partial blade is within the range of from 40 to 60 percent of the radius of the impeller.

17. The turbine of claim 11 wherein each blade has a thickness within the range of from 0.015 to 0.030 times the radius of the impeller.

* * * * *

UNITED STATES PATENT AND TRADEMARK OFFICE

CERTIFICATE OF CORRECTION

PATENT NO. : 4,904,158

DATED : February 27, 1990

INVENTOR(S) : L.C. Kun

It is certified that error appears in the above-identified patent and that said Letters Patent is hereby corrected as shown below:

In claim 1, line 16 between "liquid" and "the" insert --from--.

Signed and Sealed this

Twelfth Day of March, 1991

*Attest:*

HARRY F. MANBECK, JR.

*Attesting Officer*

*Commissioner of Patents and Trademarks*